US008211285B2

(12) United States Patent
Bronder et al.

(10) Patent No.: US 8,211,285 B2
(45) Date of Patent: Jul. 3, 2012

(54) COPPER-TIN ELECTROLYTE AND METHOD FOR DEPOSITING BRONZE LAYERS

(75) Inventors: Klaus Bronder, Spraitbach (DE); Bernd Weyhmueller, Alfdorf Hintersteinenberg (DE); Frank Oberst, Schwaebisch Gmuend (DE); Sascha Berger, Schwaebisch Gmuend (DE); Michael Lauster, Schwaebisch Gmuend (DE)

(73) Assignee: Umicore Galvanotechnik GmbH, Schwaebisch Gmuend (DE)

( * ) Notice: Subject to any disclaimer, the term of this patent is extended or adjusted under 35 U.S.C. 154(b) by 69 days.

(21) Appl. No.: 12/526,727

(22) PCT Filed: Jan. 24, 2008

(86) PCT No.: PCT/EP2008/000534

§ 371 (c)(1),
(2), (4) Date: Jan. 19, 2010

(87) PCT Pub. No.: WO2008/098666

PCT Pub. Date: Aug. 21, 2008

(65) Prior Publication Data

US 2010/0147696 A1 Jun. 17, 2010

(30) Foreign Application Priority Data

Feb. 14, 2007 (EP) ..... 07003097

(51) Int. Cl.
*C25D 3/58* (2006.01)

(52) U.S. Cl. ..... 205/241; 205/240

(58) Field of Classification Search ..... 205/241, 205/240

See application file for complete search history.

(56) References Cited

U.S. PATENT DOCUMENTS

| | | | | |
|---|---|---|---|---|
| 3,706,634 | A * | 12/1972 | Kowalski | 205/266 |
| 3,706,635 | A * | 12/1972 | Kowalski | 205/238 |
| 3,833,486 | A * | 9/1974 | Nobel et al. | 205/291 |
| 4,389,286 | A | 6/1983 | McCoy | |
| 2001/0014407 | A1 * | 8/2001 | Mitsuhashi et al. | 428/606 |

FOREIGN PATENT DOCUMENTS

| | | | |
|---|---|---|---|
| DE | 267718 | | 12/1912 |
| DE | 100 466 00 | | 4/2002 |
| EP | 1 001 054 | | 5/2000 |
| EP | 1 111 097 | A2 | 6/2001 |
| EP | 1 146 148 | A2 | 10/2001 |
| EP | 1 408 141 | A1 | 4/2004 |
| JP | 02175894 | A * | 7/1990 |
| WO | WO 2004/005528 | | 1/2004 |
| WO | WO 2004005528 | A2 * | 1/2004 |
| WO | WO 2004/027120 | A1 | 4/2004 |

OTHER PUBLICATIONS

Lu et al., "Studies on Hydroxyethylidenediphosphonic Acid Complexing Agent in the Solution for Electrodeposition of Imitation Gold", Huaxue Shijie (no month, 1995), vol. 36, No. 1, pp. 8-11).*

Ping et al., "Immersion Plating of Bronze", Metal Finishing, Nov. 1997, vol. 95, No. 11, pp. 54 and 56-57.*

* cited by examiner

*Primary Examiner* — Edna Wong

(74) *Attorney, Agent, or Firm* — Smith, Gambrell & Russell, LLP

(57) ABSTRACT

Consumer goods and industrial articles are electro-plated with bronze layers for decorative reasons and to protect them against corrosion. The electrolytes used hitherto for producing decorative bronze layers are either cyanide-containing or, as in the case of baths based on organosulphonic acids, highly corrosive or have, as in the case of cyanide-free baths based on diphosphoric acid, unsatisfactory long-term stabilities. Electrolytes which are used for applying solderable bronze layers in the electronics industry usually contain toxic or very toxic thio compounds. The present invention provides a non-toxic electrolyte which displays long-term stability for the electrolytic deposition of decorative bronze layers and a corresponding process for the application of such decorative bronze layers to consumer goods and industrial articles.

14 Claims, No Drawings

COPPER-TIN ELECTROLYTE AND METHOD FOR DEPOSITING BRONZE LAYERS

The invention relates to a copper-tin electrolyte which is free of toxic constituents such as cyanides or thio compounds. The invention further relates to a process for the deposition of decorative bronze layers on consumer goods and industrial articles using the electrolyte of the invention.

Consumer goods or consumer articles as are defined in the consumer articles regulations are upgraded by means of thin, oxidation-stable metal layers for decorative purposes and to prevent corrosion. These layers have to be mechanically stable and should not display any discoloration due to tarnishing or wear phenomena even on prolonged use. The sale of consumer goods coated with nickel-containing upgrading alloys has no longer been permitted in Europe since 2001 in accordance with EU directive 94/27/EC or is possible only under strict rules since nickel and nickel-containing metal layers are contact allergens. Bronze alloys, in particular, have become established as a replacement for nickel-containing upgrading layers and these enable such mass-produced consumer goods to be upgraded inexpensively in electrolytic drum or rack coating processes to give allergen-free, attractive products.

Known processes for producing bronze layers include not only conventional processes which use cyanide-containing and thus highly toxic alkaline baths, but also various electrolytic processes which can, according to the composition of their electrolytes, usually be assigned to one of two main groups found in the prior art: processes using electrolytes based on organosulphonic acids or processes using baths based on diphosphoric acid.

For example, EP 1 111 097 A2 describes an electrolyte which contains not only an organosulphonic acid and ions of tin and copper but also dispersants and brightening additives and also, if appropriate, antioxidants. EP 1 408 141 A1 describes a process for the electrolytic deposition of bronzes in which an acidic electrolyte containing tin and copper ions and also an alkylsulphonic acid and an aromatic, nonionic wetting agent is used. DE 100 46 600 A1 describes a bath containing alkylsulphonic or alkanolsulphonic acid together with soluble tin and copper salts and organic sulphur compounds and also a process using this bath.

A significant disadvantage of such electrolytes produced on the basis of organosulphonic acids is their high corrosivity. For example, baths based on methane-sulphonic acids frequently have pH values below one. The high corrosivity of these baths limits their use in terms of the substrate materials to be upgraded and requires the use of particularly corrosion-resistant working materials for carrying out the process.

EP 1 146 148 A2 describes a cyanide-free copper-tin electrolyte which is based on diphosphoric acid and contains the reaction product of an amine and an epihalohydrin in a molar ratio of 1:1 and also a cationic surfactant. WO 2004/005528 describes a cyanide-free diphosphoric acid-copper-tin electrolyte which contains an additive composed of an amine derivative, an epihalohydrin and a glycidyl ether compound.

Electrolytes based on diphosphoric acid generally have very limited long-term stabilities and have to be replaced frequently.

In addition, processes for producing solderable copper-tin layers which can be used as replacement for tin-lead solders and for which a wide choice of acidic base electrolytes can usually be used are known from the electronics industry. Thus, EP 1 001 054 A2 describes a tin-copper electrolyte which contains a water-soluble tin salt, a water-soluble copper salt, an inorganic or organic acid or one of their water-soluble salts and also one or more compounds from the group consisting of, generally toxic, thiourea and thiol derivatives. The bath according to the invention described there can additionally contain one or more compounds selected from the group consisting of carboxylic acids, lactones, phosphoric acid condensates, phosphonic acid derivatives and water-soluble salts thereof and also combinations thereof.

In the production of bronze layers for the electronics industry, the solderability of the resulting layer and, if appropriate, its mechanical adhesive strength are the critical properties of the layer to be produced. The appearance of the layers is generally less important for use in this field than their functionality. On the other hand, the decorative effect of the resulting layer and long-term durability of the layer with an essentially unchanged appearance are the significant target parameters for the production of bronze layers on consumer goods.

SUMMARY OF THE INVENTION

It is therefore an object of the present invention to provide an electrolyte which has long-term stability and is suitable for the deposition of mechanically stable and decorative bronze layers on consumer goods and industrial articles and is free of toxic constituents. A further object of the present invention is to provide a process for the application of decorative bronze layers to consumer goods and industrial articles using an electrolyte which is free of toxic constituents.

DETAILED DESCRIPTION OF INVENTION

This object is achieved by an electrolyte which contains the metals to be deposited in the form of water-soluble salts together with one or more phosphonic acid derivatives as complexing agents. Toxic constituents such as cyanides and thio compounds such as thiourea derivatives and thiol derivatives are not present in the electrolyte of the invention. In addition, a process by means of which decorative bronze alloy layers can be applied to consumer goods and industrial articles using the non-toxic electrolyte of the invention is made available.

For the purposes of the present text, "non-toxic" means that the inventive electrolyte designated in this way does not contain any substances which are to be classified as "toxic" (T) or "very toxic" ($T^+$) according to the regulations for handling dangerous goods and hazardous substances which are applicable in Europe.

The electrolyte of the invention contains the metals to be deposited copper and tin or copper, tin and zinc. They are introduced in the form of water-soluble salts which are preferably selected from the group consisting of sulphites, sulphates, phosphates, diphosphates, nitrites, nitrates, halides, hydroxides, oxide-hydroxides and oxides and combinations thereof. Which salts are introduced in which amount into the electrolyte determines the colour of the resulting decorative bronze layers and can be set according to customer requirements. For application of decorative bronze layers to consumer goods and industrial articles, the electrolyte of the invention preferably contains from 0.2 to 5 gram per litre of copper, from 0.5 to 20 gram per litre of tin and from 0 to 5 gram per litre of zinc, in each case based on the volume of the electrolyte. For upgrading consumer goods, particular preference is given to introducing the metals to be deposited as sulphates, phosphates, diphosphates or chlorides in such amounts that the resulting ion concentration is in the range from 0.3 to 3 gram of copper, from 2 to 10 gram of tin and from 0 to 3 gram of zinc, in each case per litre of electrolyte.

The application of the decorative bronze layers to consumer goods and industrial articles by means of the electrolyte of the invention is carried out in an electrolytic process. Here, it is important that the metals to be deposited are permanently kept in solution during the process, regardless of whether electrolytic coating is carried out in a continuous process or a batch process.

To ensure this, the electrolyte of the invention contains phosphonic acid derivatives as complexing agents.

Preference is given to using the compounds amino-phosphonic acid AP, 1-aminomethylphosphonic acid AMP, aminotris(methylenephosphonic acid) ATMP, 1-aminoethylphosphonic acid AEP, 1-aminopropylphosphonic acid APP, (1-acetylamino-2,2,2-trichloroethyl)phosphonic acid, (1-amino-1-phosphonooctyl)phosphonic acid, (1-benzoylamino-2,2,2-trichloroethyl)phosphonic acid, (1-benzoylamino-2,2-dichlorovinyl)phosphonic acid, (4-chloro-phenylhydroxymethyl)phosphonic acid, diethylenetriaminepenta(methylenephosphonic acid) DTPMP, ethylenediaminetetra(methylenephosphonic acid) EDTMP, 1-hydroxyethane(1,1-diphosphonic acid) HEDP, hydroxyethylaminodi(methylenephosphonic acid) HEMPA, hexamethylenediaminetetra(methylphosphonic acid) HDTMP, ((hydroxymethylphosphonomethylamino)methyl)phosphonic acid, nitrilotris(methylenephosphonic acid) NTMP, 2,2,2-trichloro-1-(furan-2-carbonyl)aminoethyl-phosphonic acid, salts derived therefrom or condensates derived therefrom, or combinations thereof.

Particular preference is given to using one or more compounds selected from the group consisting of amino-tris(methylenephosphonic acid) ATMP, diethylenetri-aminepenta (methylenephosphonic acid) DTPMP, ethylene-diaminetetra (methylenephosphonic acid) EDTMP, 1-hydroxyethane(1,1-diphosphonic acid) HEDP, hydroxy-ethylaminodi (methylenephosphonic acid) HEMPA, hexamethylenediaminetetra(methylphosphonic acid) HDTMP, salts derived therefrom and condensates derived therefrom and combinations thereof. Preference is given to using from 50 to 200 gram of phosphonic acid derivatives per litre of electrolyte, particularly preferably from 75 to 125 gram per litre of electrolyte.

The pH of the electrolyte of the invention, which is strongly influenced by the type and amount of phosphonic acid derivatives used and represents an important influencing parameter for the long-term stability of the electrolyte, is set to a value in the range from 6 to 14, preferably from 8 to 12.

In addition to the metals to be deposited and the phosphonic acid derivatives used as complexing agents, the electrolyte can also contain organic additives which perform functions as brighteners, wetting agents or stabilizers. The addition of brighteners and wetting agents is preferred only in the case of specific requirements in terms of the appearance of the decorative bronze layers to be deposited. In addition to the colour of the bronze layers, which depends critically on the ratio of the metals to be deposited, these additives make it possible to set the brightness of the layer in all gradations between silk-matt and high gloss.

Preference is given to adding one or more compounds selected from the group consisting of monocarboxylic and dicarboxylic acids, alkanesulphonic acids and aromatic nitro compounds. These compounds act as electrolyte bath stabilizers. Particular preference is given to using oxalic acid, alkanesulphonic acids or nitrobenzotriazoles or mixtures thereof.

The electrolyte of the invention is free of hazardous substances classified as toxic (T) or highly toxic ($T^+$). No cyanides, no thiourea derivatives and no thiol derivatives are present. In particular, the addition of the thio compounds mentioned has an adverse effect on the coating result. Bronze layers which have been deposited electrolytically from baths with addition of thio compounds have a spotty or matt, fogged appearance and are for this reason not suitable for decorative coating of consumer goods.

The non-toxic electrolyte of the invention is particularly suitable for the electrolytic application of decorative bronze layers to consumer goods and industrial articles. It can be used in drum, rack, belt or run-through electroplating units.

In a corresponding process for the electrolytic application of decorative bronze alloy layers, the consumer goods and industrial articles to be coated (hereinafter referred to collectively as substrates) dip into the non-toxic electrolyte of the invention and form the cathode. The electrolytes are preferably maintained at a temperature in the range from 20 to 70° C. A current density which is in the range from 0.01 to 100 ampere per square decimetre [$A/dm^2$] and is dependent on the type of coating unit is preferably set. Thus, current densities in the range from 0.05 to 0.50 $A/dm^2$ are particularly preferred in drum coating processes. In rack coating processes, current densities in the range from 0.2 to 10 $A/dm^2$, particularly preferably from 0.2 to 5 $A/dm^2$, are preferably chosen.

When using the non-toxic electrolyte of the invention, it is possible to employ various anodes. Soluble or insoluble anodes are equally suitable, and it is also possible to use a combination of soluble and insoluble anodes.

As soluble anodes, preference is given to using anodes made of a material selected from the group consisting of electrolytic copper, phosphorus-containing copper, tin, tin-copper alloys, zinc-copper alloys and zinc-tin-copper alloys. Combinations of various soluble anodes composed of these materials and also combinations of soluble tin anodes with insoluble anodes are particularly preferred.

As insoluble anodes, preference is given to using anodes made of a material selected from the group consisting of platinized titanium, graphite, iridium-transition metal mixed oxides and special carbon material ("diamond-like carbon", DLC) or combinations of these anodes. Mixed oxide anodes composed of iridium-ruthenium mixed oxide, iridium-ruthenium-titanium mixed oxide or iridium-tantalum mixed oxide are particularly preferred.

If insoluble anodes are employed, a particularly preferred embodiment of the process is obtained when the substrates which are to be provided with decorative bronze layers and represent the cathode are separated from the insoluble anode by an ion-exchange membrane so as to form a cathode space and an anode space. In such a case, only the cathode space is filled with the non-toxic electrolyte of the invention. An aqueous solution which contains only an electrolyte salt is preferably present in the anode space. Such an arrangement prevents anodic oxidation of tin(II) ions $Sn^{2+}$ to tin(IV) ions $Sn^{4+}$, which would have an adverse effect on the coating process.

In membrane processes which are operated using insoluble anodes and the non-toxic electrolyte of the invention, current densities in the range from 0.05 to 2 $A/dm^2$ are preferably set. The electrolyte is preferably maintained at a temperature in the range from 20 to 70° C. As ion-exchange membranes, it is possible to use cationic or anionic exchange membranes. Preference is given to using membranes which are composed of Nafion and have a thickness of from 50 to 200 μm.

The examples described below and the comparative example illustrate the invention.

In all experiments described, an insoluble platinum-titanium anode was used.

Example 1

Drum deposition of yellow bronze layers was carried out using a non-toxic electrolyte according to the invention which contained 120 g/l of hydroxyethylamino-di(methylenephosphonic acid) HEMPA, 2 g/l of copper as copper sulphate, 6 g/l of tin as tin sulphate and 0.1 g/l of low molecular weight polyethylenimine in water. The pH of the electrolyte was 11.

During the entire deposition process, the electrolyte was maintained at 60° C. At a current density set in the range from 0.1 to 0.2 A/dm$^2$, optically uniform bronze layers having the yellowish colour typical of bronze were obtained in an apparatus for drum coating.

Example 2

To produce yellow bronze layers in an apparatus in which the substrates forming the cathode were fastened to a rack, use was made of a non-toxic electrolyte according to the invention containing 100 g/l of ethylenediaminetetra(methylenephosphonic acid) EDTMP, 4 g/l of copper as copper diphosphate, 5 g/l of tin as tin diphosphate and 3 g/l of zinc as zinc diphosphate dissolved in water. The bath additionally contained 15 g/l of methanesulphonic acid as stabilizer. The pH of the bath was 8.

At a current density set in the range from 0.5 to 1 A/dm$^2$ and an electrolyte maintained at a temperature of 50° C., optically defect-free bronze layers having a yellow colour were obtained.

Example 3

Deposition of white bronze layers was carried out using an electrolyte containing 50 g/l of ethylenediamine-tetra(methylenephosphonic acid) EDTMP and 50 g/l of 1-hydroxyethane(1,1-diphosphonic acid) HEDP in aqueous solution. 0.5 g/l of copper as copper sulphate, 4.0 g/l of tin as tin sulphate and 2 g/l of zinc as zinc sulphate were present as metals to be deposited. The non-toxic electrolyte according to the invention had a pH of 10. At a bath temperature of 50° C. and a current density of from 0.1 to 0.2 A/dm$^2$, mechanically stable and attractive white bronze layers were obtained in drum and rack coating processes.

Example 4

Drum deposition of white bronze was carried out using an electrolyte according to the invention containing 100 g/l of ethylenediaminetetra(methylenephosphonic acid) EDTMP, 0.5 g/l of copper as copper diphosphate, 5 g/l of tin as tin diphosphate, 2 g/l of zinc as zinc diphosphate and 15 g/l of the stabilizing methane-sulphonic acid in water. The pH of the electrolyte was 10. The electrolyte was maintained at 50° C. during the deposition process.

At a current density set in the range from 0.05 to 0.2 A/dm$^2$, layers which had the whitish metallic sheen typical of white bronze and were optically uniform and displayed a good mechanical adhesive strength were obtained.

Example 5

Likewise defect-free white bronze layers were obtained using an electrolyte containing 90 g/l of 1-hydroxy-ethane(1,1-diphosphonic acid) HEDP in a rack coating process. The concentrations of the metals to be deposited were 0.5 g/l of copper as copper chloride, 5 g/l of tin as tin chloride and 1 g/l of zinc as zinc chloride. 0.05 g/l of the sodium salt of propargyl-sulphonic acid was present as stabilizer. The pH of the bath was 9, the bath temperature during the entire coating process was 55° C. and the current density set was 0.2 A/dm$^2$.

Example 6

The use of an electrolyte according to the invention which contained 0.5 g/l of copper as copper chloride, 5 g/l of tin as tin chloride and 1.5 g/l of vanillin together with the sodium salt of diethylenetriamine-penta(methylenephosphonic acid) DTPMP in a concentration of 80 g/l, had a pH of 8 and was maintained at 50° C. enabled likewise optically defect-free white bronze layers to be produced in rack and drum coating processes at a current density set in the range from 0.1 to 0.2 A/dm$^2$.

Example 7

Use of an electrolyte according to the invention which contained 0.5 g/l of copper as copper diphosphate, 5 g/l of tin as tin diphosphate, 2 g/l of zinc as zinc diphosphate and 20 g/l of methanesulphonic acid together with ethylenediaminetetra (methylenephosphonic acid) EDTMP in a concentration of 80 g/l and 10 g/l of aminotris(methylenephosphonic acid) ATMP, had a pH of 10 and was maintained at 50° C. enabled optically defect-free bronze layers which had an anthracite grey to black colour and had good mechanical properties to be obtained at a current density set at 0.1 A/dm$^2$.

All electrolytes described in the examples are, when the process parameters indicated are adhered to, highly suitable for applying decorative bronze layers to consumer goods and industrial articles.

Comparative Example

Using the experimental set-up described in Example 2, three further coating experiments were carried out using three different electrolytes. All electrolytes were based on the inventive formulation selected in Example 2 and contained 100 g/l of ethylenediamine-tetra(methylenephosphonic acid) EDTMP, 4 g/l of copper as copper diphosphate, 5 g/l of tin as tin diphosphate and 3 g/l of zinc as zinc diphosphate in water. The baths additionally contained 15 g/l of the stabilizing methanesulphonic acid and also small amounts of a thio compound, namely:

a.) thioglycolic acid in a first bath tested for comparison;

b.) thiolactic acid in a second bath tested for comparison c.) thiourea in a third bath tested for comparison.

The process parameters selected corresponded to the conditions set in Example 2.

All three comparative baths gave a poor coating result. The resulting bronze layers were mechanically stable but optically unattractive, i.e. spotty, matt and of a fogged appearance.

None of these baths is suitable for the application of decorative bronze layers to consumer goods and industrial articles.

What is claimed is:

1. An electrolyte, for the deposition of a decorative bronze alloy layer which is optically defect-free and has an anthracite grey to black color on a substrate, which comprises water-soluble salts of copper, tin and zinc which form the decorative bronze alloy layer and phosphonic acids consisting of aminotris(methylenephosphonic acid) and ethylene-diaminetetra (methylenephosphonic acid), wherein said electrolyte is free of cyanides, additional phosphonic acids, thiourea derivatives and thiol derivatives and wherein the copper, tin and zinc are in an ionically dissolved form and the ionic concentration of copper is in the range from 0.2 to 5 gram per liter of electrolyte, the ionic concentration of tin is in the range from 0.5 to 20 gram per liter of electrolyte, and the ionic concentration of zinc is in the range from up to 5 gram per liter of electrolyte.

2. The electrolyte according to claim 1, wherein the pH of the electrolyte is in the range from 6 to 14.

3. The electrolyte according to claim 1, and further comprising one or more stabilizing compounds selected from the group consisting of monocarboxylic acids, dicarboxylic acids, and aromatic nitro compounds.

4. The electrolyte according to claim 1, wherein the water-soluble salts are selected from the group consisting of sulphites, sulphates, phosphates, diphosphates, nitrites, nitrates, halides, hydroxides, oxide-hydroxides, oxides and combinations thereof.

5. The electrolyte according to claim 1, wherein the electrolyte is non-toxic.

6. A process for the electrolytic application of a decorative bronze alloy layer which is optically defect-free and has an anthracite grey to black color to a substrate, which comprises dipping the substrate into an electrolyte comprising water-soluble salts of copper, tin and zinc which form the decorative bronze alloy layer and phosphonic acids consisting of aminotris(methylenephosphonic acid) and ethylene-diaminetetra (methylenephosphonic acid), wherein said electrolyte is free of cyanides, additional phosphonic acids, thiourea derivatives and thiol derivatives, and wherein the copper, tin and zinc are in an ionically dissolved form and the ionic concentration of copper is in the range from 0.2 to 5 gram per liter of electrolyte, the ionic concentration of tin is in the range from 0.5 to 20 gram per liter of electrolyte, and the ionic concentration of zinc is in the range from up to 5 gram per liter of electrolyte, and applying an electrical current thereto.

7. The process according to claim 6, wherein the electrolyte is maintained at a temperature in the range from 20 to 70° C.

8. The process according to claim 7, which further comprises setting a current density in the range from 0.01 to 100 ampere per square decimetre.

9. The process according to claim 8, which further comprises using a soluble anode made of a material selected from the group consisting of electrolytic copper, phosphorus-containing copper, tin, tin-copper alloys, zinc-copper alloys, zinc-tin-copper alloys, and combinations thereof.

10. The process according to claim 8, which further comprises using an insoluble anode made of a material selected from the group consisting of platinized titanium, graphite, iridium-transition metal mixed oxides, a diamond-like carbon, and combinations thereof.

11. The process according to claim 10, wherein the substrate and the insoluble anode are separated from one another by an ion-exchange membrane to form a cathode space and an anode space and only the cathode space contains the electrolyte so that anodic oxidation of $Sn^{2+}$ to $Sn^{4+}$ is prevented.

12. The process according to claim 7, which further comprises using an insoluble anode made of a material selected from the group consisting of platinized titanium, graphite, iridium-transition metal mixed oxides, a diamond-like carbon, and combinations thereof and a soluble anode made of a material selected from the group consisting of electrolytic copper, phosphorus-containing copper, tin, tin-copper alloys, zinc-copper alloys, zinc-tin-copper alloys, and combinations thereof.

13. The process according to claim 12, wherein the substrate and the insoluble anode are separated from one another by an ion-exchange membrane to form a cathode space and an anode space and only the cathode space contains the electrolyte so that anodic oxidation of $Sn^{2+}$ to $Sn^{4+}$ is prevented.

14. The process according to claim 6, wherein the electrolyte is non-toxic.

* * * * *